US006874907B2

(12) United States Patent
Liao

(10) Patent No.: US 6,874,907 B2
(45) Date of Patent: Apr. 5, 2005

(54) USB-CHARGEABLE EMERGENCY LIGHT STRUCTURE

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/351,381

(22) Filed: Jan. 27, 2003

(65) Prior Publication Data

US 2004/0145890 A1 Jul. 29, 2004

(51) Int. Cl.[7] ..... F21L 4/02; F21L 4/08

(52) U.S. Cl. ..... 362/183; 362/185; 362/195; 362/226

(58) Field of Search ..... 362/183, 114, 362/113, 115, 195, 202, 184, 201, 457, 226, 368, 185; 320/107

(56) References Cited

U.S. PATENT DOCUMENTS 6,127,803 A * 10/2000 Wang et al. ..... 320/114
6,555,990 B1 * 4/2003 Yang ..... 320/113
2003/0117104 A1 * 6/2003 Liao ..... 320/107

* cited by examiner

*Primary Examiner*—Sandra O'Shea
*Assistant Examiner*—Guiyoung Lee
(74) *Attorney, Agent, or Firm*—Browdy and Neimark, P.L.L.C.

(57) ABSTRACT

A USB-chargeable emergency light structure has a light base, a charging/outputting circuit unit, a connector and a charging socket. The light base defines an accommodating space therein for receiving the charging/outputting circuit unit that has a plurality of light sources. The connector partially protrudes from the base and is electrically connected to the charging/outputting circuit unit. The connector is a USB connector. The charging socket is mounted on the light base and electrically connected to the charging/outputting circuit unit. The lighting structure thereby constructed can be used as an emergency light, a night light, a flashlight or a charging device.

9 Claims, 9 Drawing Sheets

USB-CHARGEABLE EMERGENCY LIGHT STRUCTURE

BACKGROUND OF THE INVENTION

1. Field of the Invention

The invention relates to a USB-chargeable emergency light structure and, more particularly, to a USB-chargeable emergency light structure which can be used as an emergency light, a night light, a flashlight or a charging device.

2. Description of the Related Art

An emergency light typically emits light when there is a failure of electric power supply. A conventional emergency light is limited to insertion in an electric socket only for domestic power distribution.

As the electronic industry progresses, electric appliances such as a desktop computer, a laptop computer, a cellular phone or a personal digital assistant (PDA) have become increasingly common everywhere. However, the conventional emergency light is not compatible with these electric appliances. Furthermore, a conventional charging device cannot provide functions other than electric recharging.

SUMMARY OF INVENTION

It is therefore one object of the invention to provide a universal serial bus (USB)-chargeable emergency light structure that can be used as an emergency light, a night light, a flashlight or a charging device, and is supplied with electric power by either an external electric appliance or a chargeable battery.

In order to achieve the above and other objectives, the invention provides a USB-chargeable emergency light structure that includes a light base, a charging/outputting circuit unit, a connector and a charging socket. The light base defines an accommodating space therein for receiving the charging/outputting circuit unit that has a plurality of light sources. The connector partially protrudes from the base and is electrically connected to the charging/outputting circuit unit. The connector of the invention is preferably a USB connector through which the lighting structure is externally connected to the electric appliance for power charging. The charging socket is mounted on the light base and electrically connected to the charging/outputting circuit unit.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
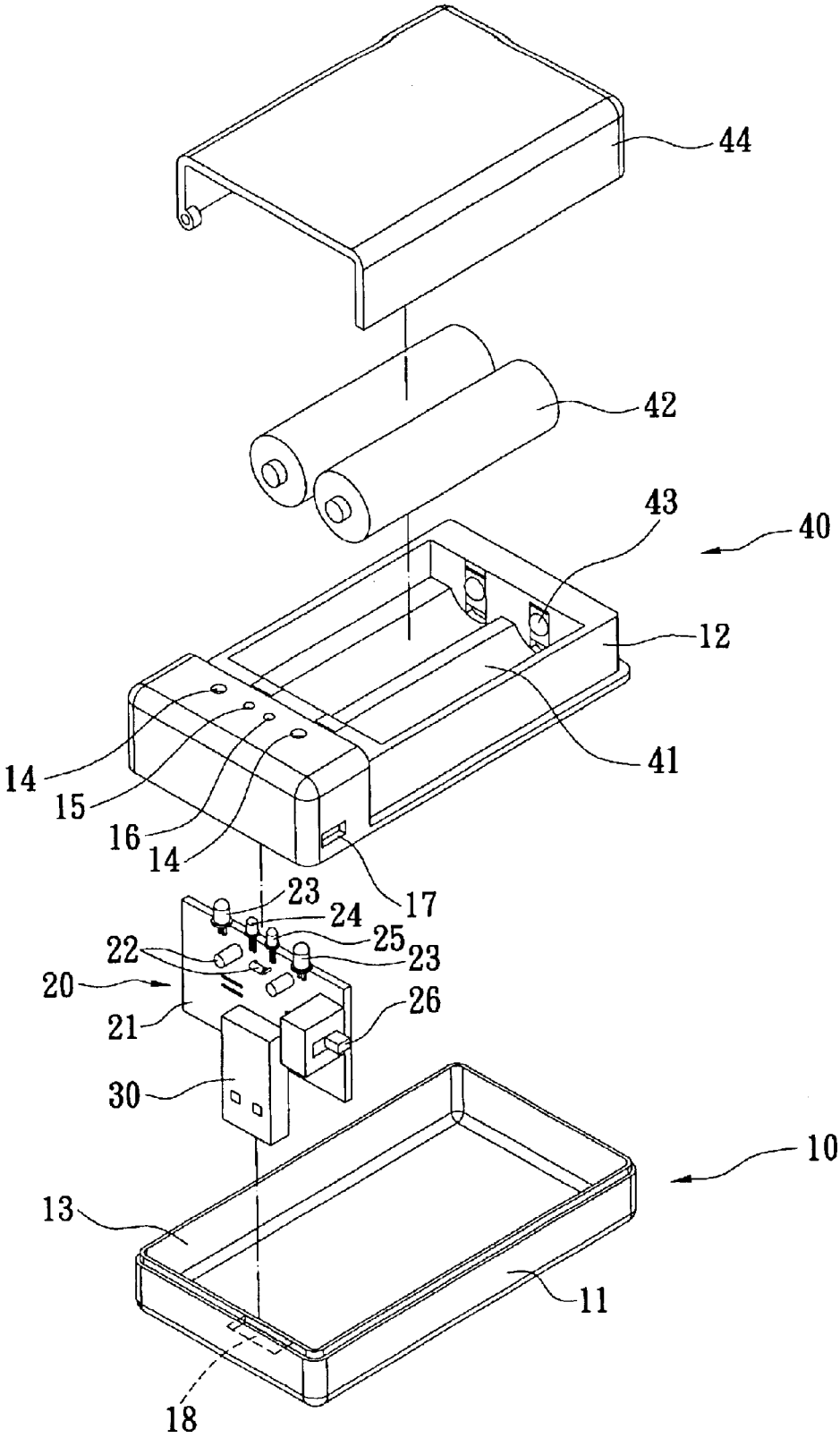
FIG. 1 is a schematic, exploded view of a USB-chargeable emergency light structure according to a first embodiment of the invention.

Wherever possible in the following description, like reference numerals will refer to like elements and parts unless otherwise illustrated.

Figure 2:
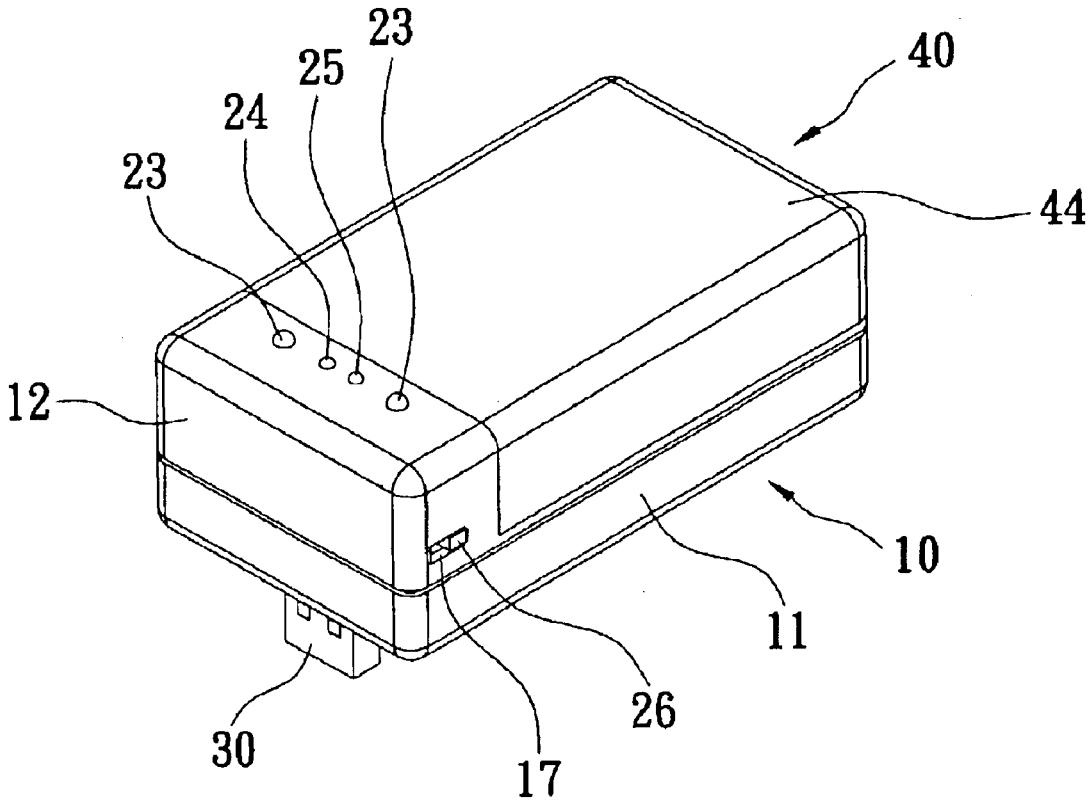
FIG. 2 is a schematic, perspective view of a USB-chargeable emergency light structure according to a first embodiment of the invention.
Figure 3:
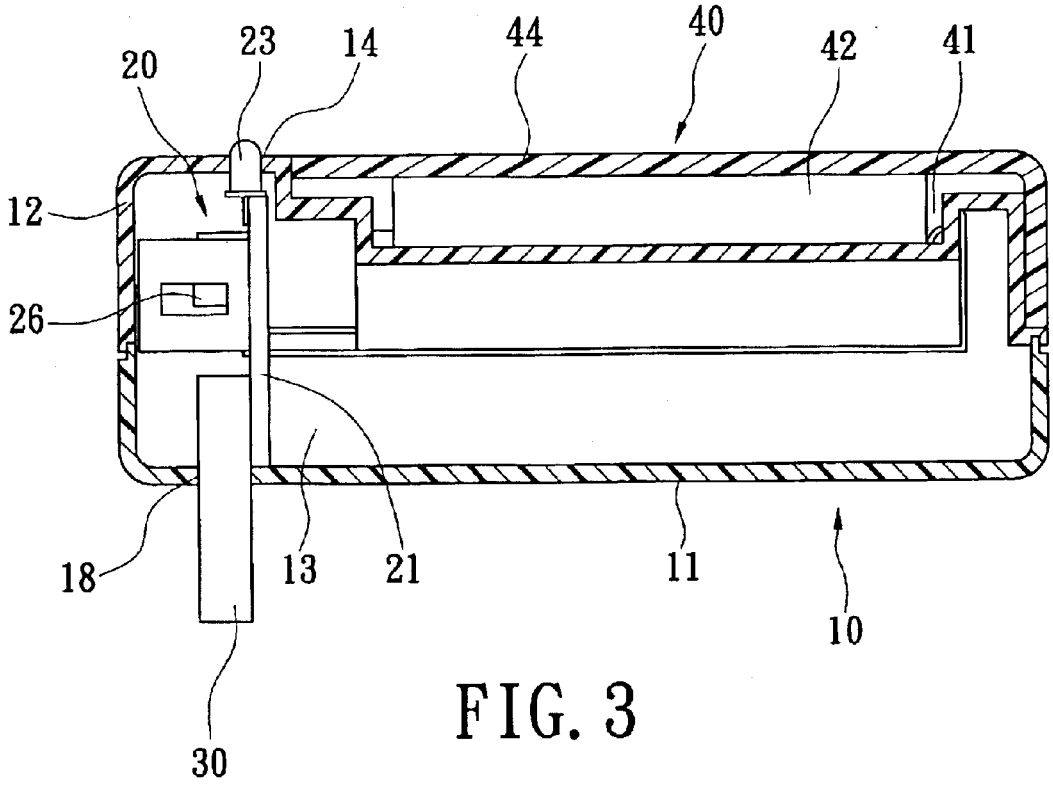
FIG. 3 is a schematic, cross-sectional view of a USB-chargeable emergency light structure according to a first embodiment of the invention.

Referring to FIGS. 1–3, the invention provides a multi-functional USB-chargeable emergency light structure that includes a light base 10, a charging/outputting circuit unit 20, a connector 30 and a charging socket 40. The light base 10 includes a first base portion 11 and a second base portion 12 that are connected to each other by a snap fitting, clasps, screws, or ultrasonic welding to define an accommodating space 13 for receiving the charging/outputting circuit unit 20. A plurality of light holes 14, 15, 16, a switch hole 17 and a connector hole 18 are respectively formed through an external surface of the light base 10.

The charging/outputting circuit unit 20 includes a circuit board 21 and a plurality of electronic components 22. The charging/outputting circuit unit 20 receives an electric power input and performs charging and electric power outputting. Two lighting sources 23 are mounted on the circuit board 21. The lighting sources 23 are, for example, light emitting diodes (LED) or bulbs used as an emergency light, a night light or a flashlight. The lighting sources 23 are respectively mounted in corresponding light holes 14 to emit the light through the light holes 14. A power indicator lighting 24 and a charging status indicator lighting 25 are further mounted on the circuit board 21, respectively in the corresponding light holes 15, 16 for showing the operation status. A switch 26 is further mounted on the circuit board 21 in the corresponding switch hole 17. Turning on/off the lighting sources 23 and the charging socket 40 is controlled by the switch 26. The charging/outputting circuit unit 20 can be further provided with a dimmer (not shown) by which the light emitted from the light sources 23 is adjusted as desired. For example, the light of the light sources 23 can be adjusted to be that for a night light or flashlight.

The connector 30 is electrically connected through the circuit board 21 to the charging/outputting circuit unit 20. Furthermore, the connector 30 partially protrudes from the base 10 via the corresponding connector hole 18 for externally connecting an electric appliance such as a laptop computer, a desktop computer or a cellular phone. The connector 30 is, for example, a universal serial bus (USB) connector.

The charging socket 40 is mounted on the base 10. The charging socket 40 has an opening 41 for receiving a chargeable battery 42. A guiding piece 43 is respectively mounted on two opposite inner sides of the opening 41. When the chargeable battery 42 is placed in the opening 41, the conductive terminals of the chargeable battery 42 come in contact with the guiding pieces 43. The guiding pieces 43 are electrically connected to the charging/outputting circuit unit 20 with a conductive wire (not shown), so that the charging socket 40 is electrically connected to the charging/outputting circuit unit 20. A cover 44 is further pivotally mounted on the charging socket 40 to cover the opening 41. The USB-chargeable emergency light structure of the invention is thereby achieved.

Figure 5:
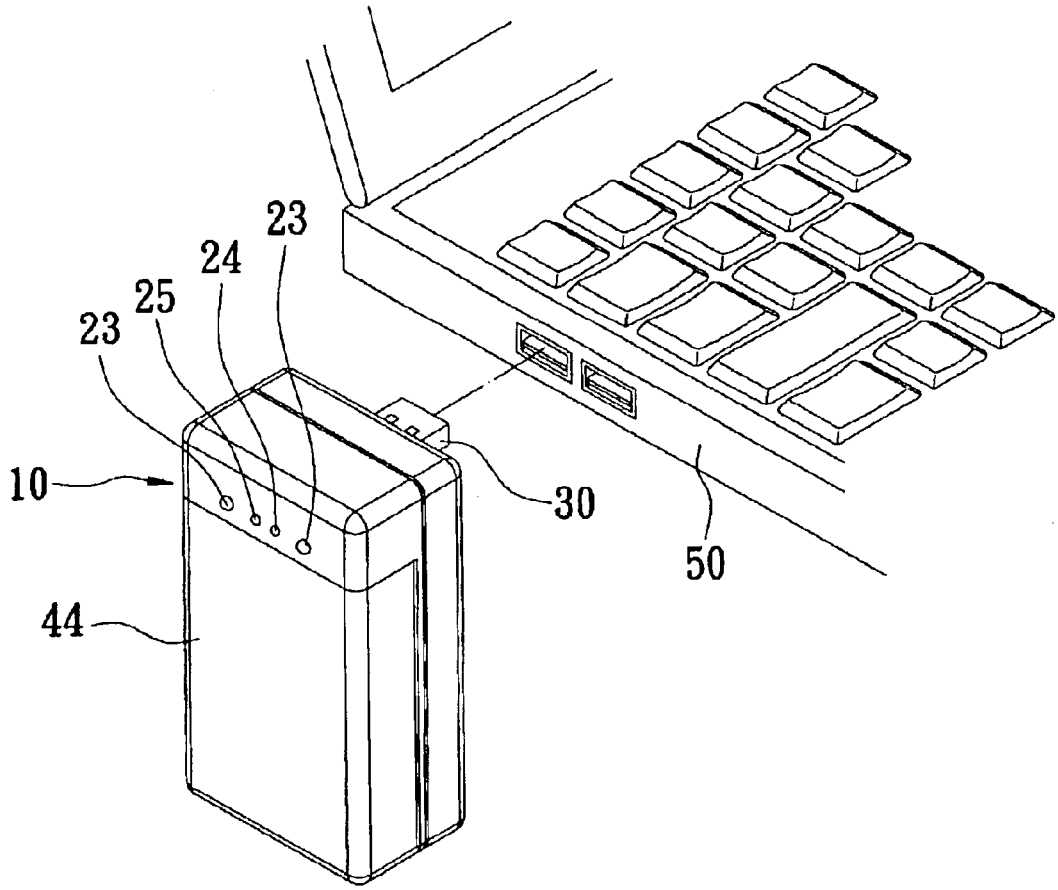
FIG. 5 is a schematic, perspective view illustrating a connector of a USB-chargeable emergency light structure inserted in an external electric appliance according to a first embodiment of the invention.

Referring to FIG. 5, the connector 30 of the USB-chargeable emergency light structure of the invention is inserted in an output port of the electric appliance 50 such as a laptop computer, a desktop computer or a cellular phone. The electric appliance 50 thereby supplies the charging/outputting circuit unit 20, the light sources 23 and the charging socket 40 with the needed electric power to allow the charging of the battery 42 in the charging socket 40.

Figure 6:
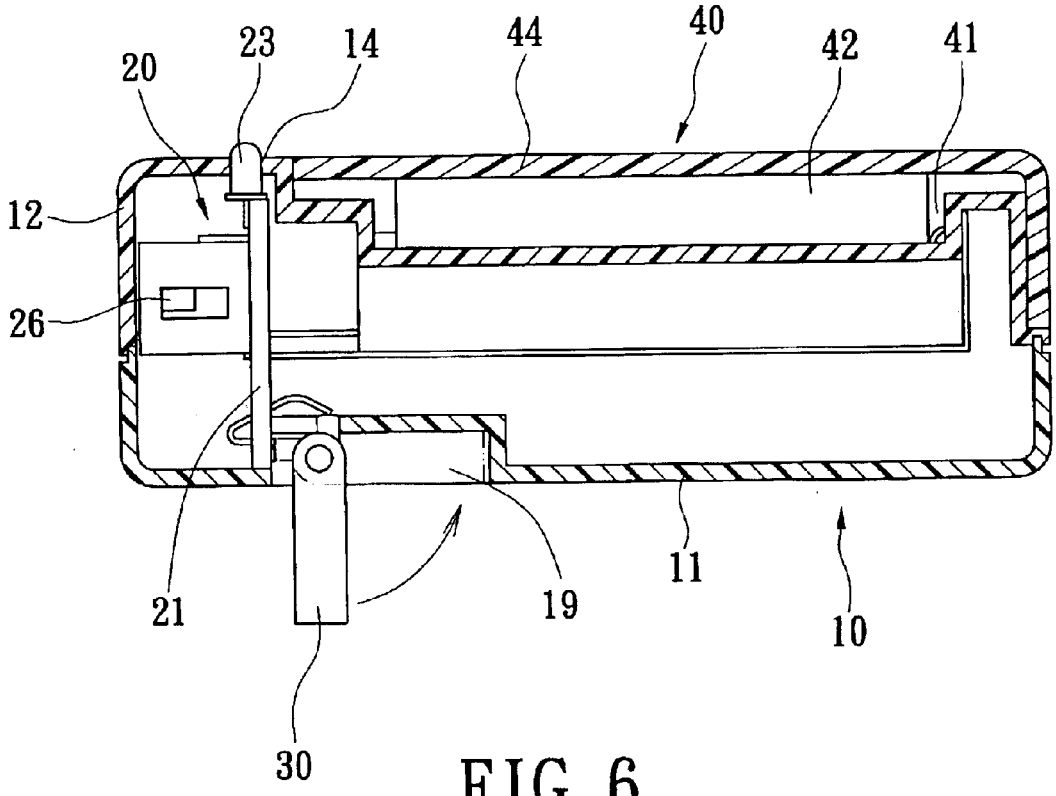
FIG. 6 is a schematic, cross-sectional view of a USB-chargeable emergency light structure according to a second embodiment of the invention.

Referring to FIG. 6, the connector 30 of the invention can be pivotally connected to the circuit board 21 in a foldable way. When the connector 30 is not in use, it is folded in a connector receiving space 19 for convenient carrying.

Figure 4:
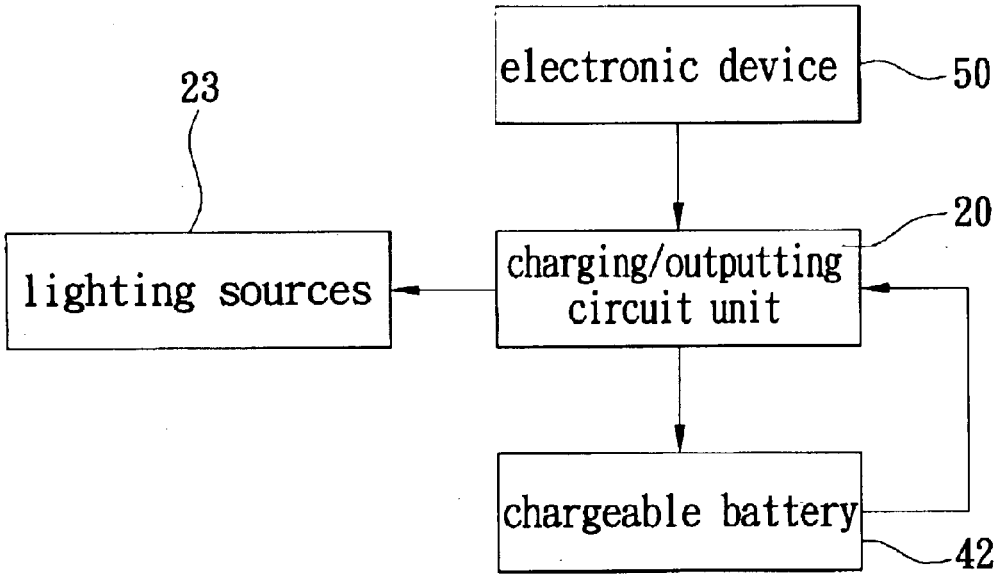
FIG. 4 is a circuit block diagram of a USB-chargeable emergency light structure according to a first embodiment of the invention.

The lighting structure of the invention may be used as an emergency light, a night light, a flashlight and a charging device. Furthermore, the electric appliance 50 to which the connector 30 is externally connected supplies the power required to charge the lighting structure of the invention. The charged battery 42 thereby supplies the power to the charging/outputting circuit unit 20 and the light sources 23 in case of a cutoff of electric power supply, as illustrated in FIG. 4.

Figure 7:
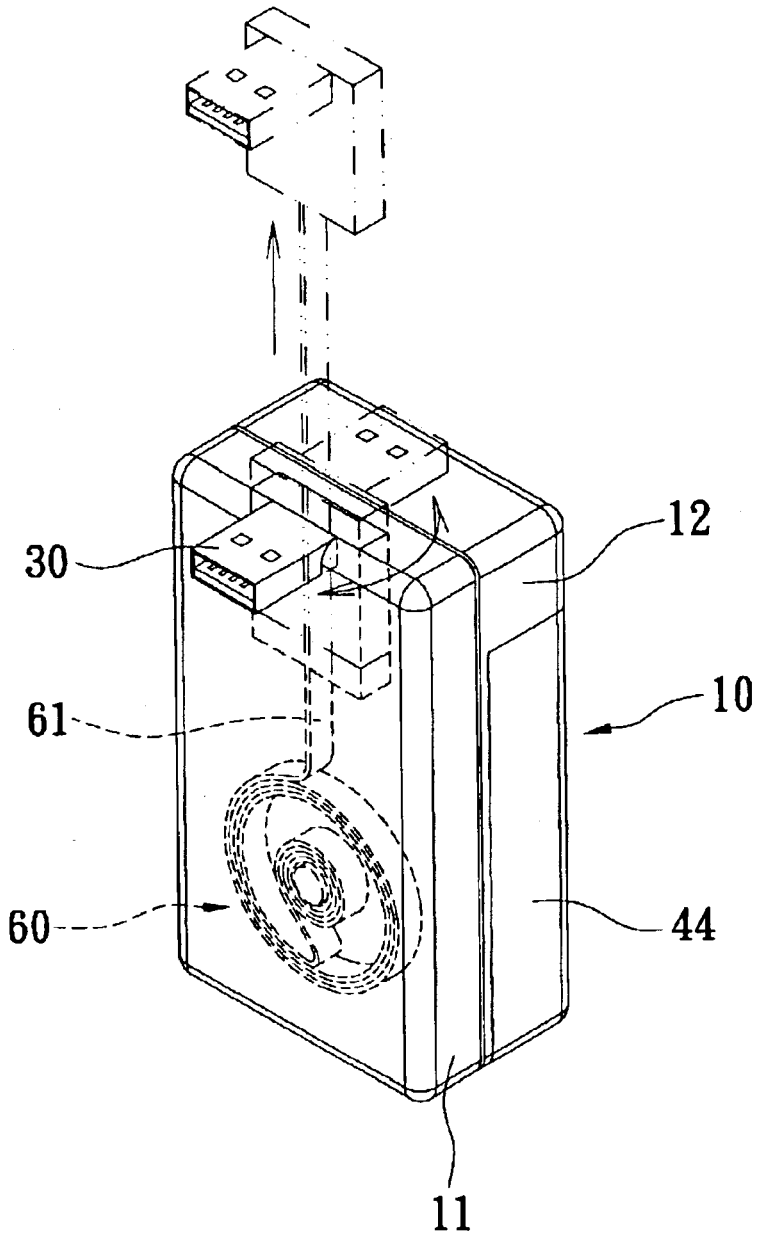
FIG. 7 is a schematic view of an assembled USB-chargeable emergency light structure according to a third embodiment of the invention.

Referring to FIG. 7, a winding reel 60 around which a plurality of wires 61 is wound is placed inside the light base 10. The wires 51 are either wound up in the light base 10 or partially pulled out from the light base 10. The connector 30 is connected to one tip of the wires 61 in a manner that allows pulling out of the connector 30. The connector 30 thereby can be conveniently inserted into the external electric appliance 50.

Figure 8:
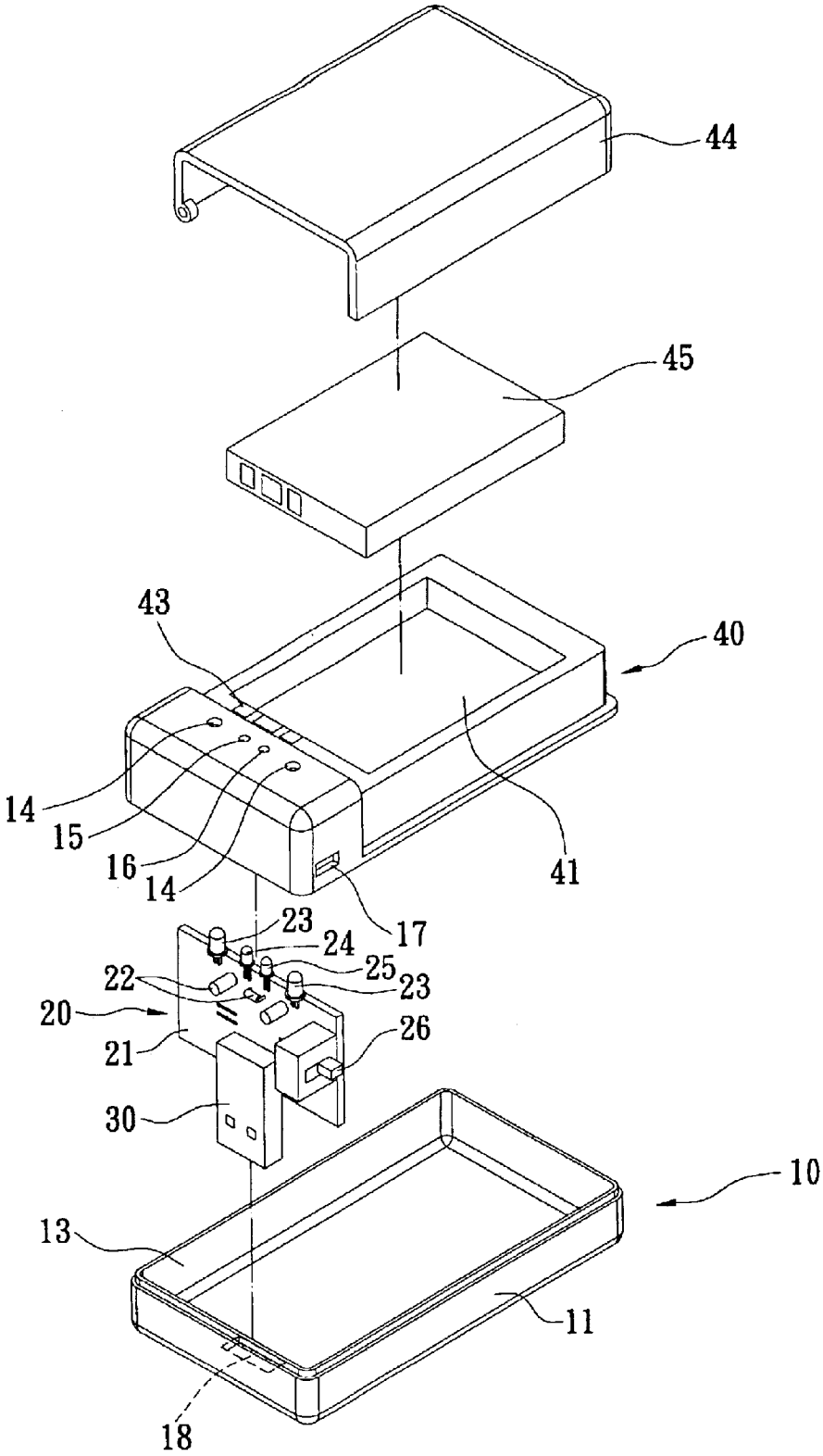
FIG. 8 is a schematic, exploded view of a USB-chargeable emergency light structure according to a fourth embodiment of the invention.

Referring to FIG. 8, the charging socket 40 of the invention can have various shapes for adequately receiving batteries 45 of different shapes.

Figure 9:
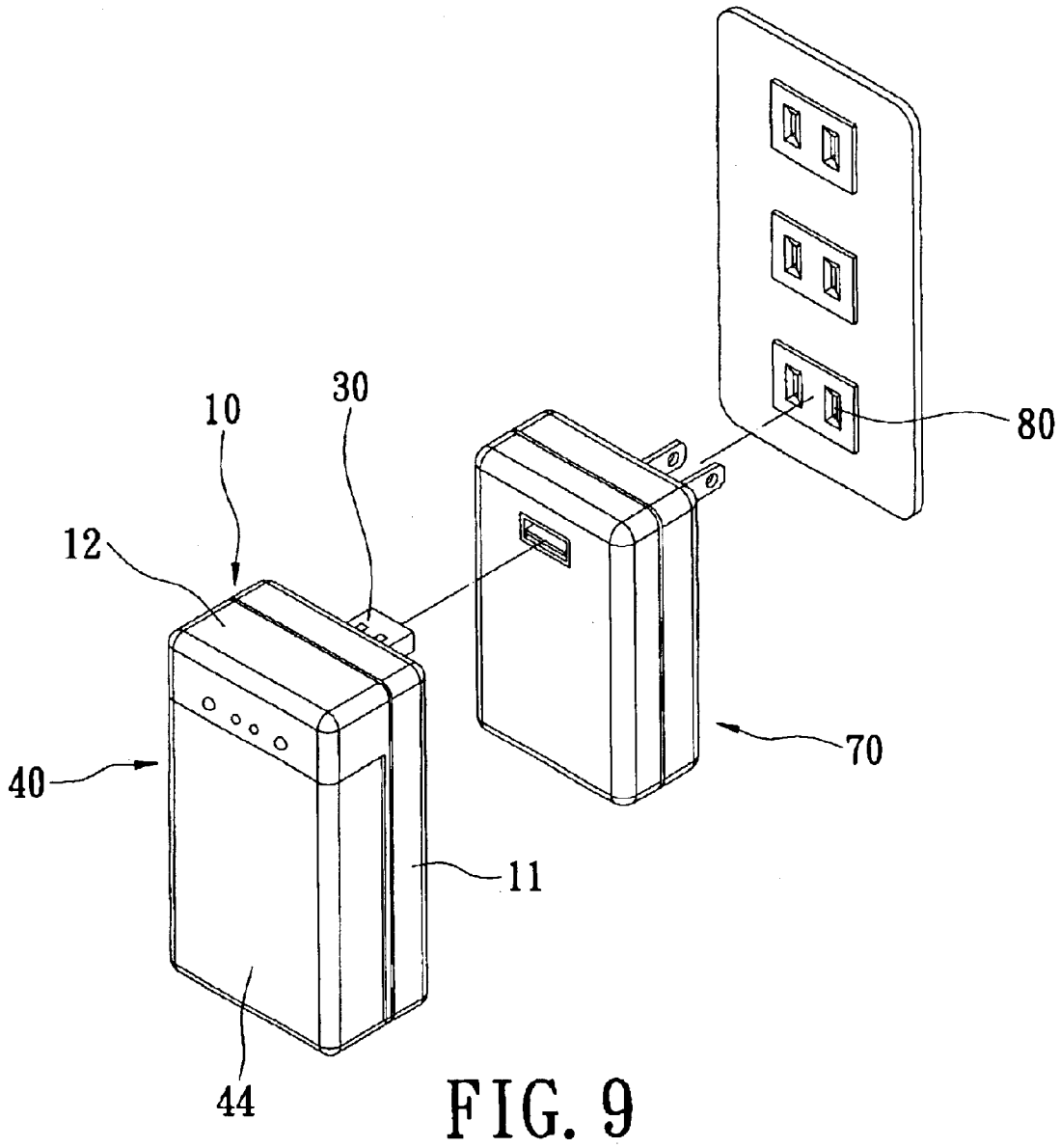
FIG. 9 is a schematic, exploded view illustrating the use of a USB-chargeable emergency light structure according to a fifth embodiment of the invention.

Referring to FIG. 9, the connector 30 of the invention can be optionally inserted to an electric socket 80 for domestic electric distribution via an adapter 70. The charging/outputting circuit unit 20, the light source 23 and the charging socket 40 can thereby be widely used.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A universal serial bus (USB)-chargeable emergency light structure comprising:

a light base including a first base portion and a second base portion adapted to be connected to each other, and defining an accommodating space formed therebetween, wherein the second base portion has a configuration appropriate to that of the first base portion, so that the second base portion fits inside the first base portion;

a charging/outputting circuit unit mounted inside the accommodating space and having a plurality of light sources, wherein the light sources are exposed out of a front side of the second base portion for lighting an area;

a USB connector electrically secured to the charging/outputting circuit unit, wherein the USB connector partially protrudes downwardly from and exposes out of the first base portion of the light base; and a charging socket mounted inside the second base portion of the light base and electrically connected to the charging/outputting circuit unit.

2. The lighting structure of claim 1, wherein the first base portion connects to the second base portion by snap fitting, clasping screwing, or ultrasonic welding.

3. The lighting structure of claim 1, wherein the light base has a plurality of light holes formed thereon through which the light sources penetrate correspondingly.

4. The lighting structure of claim 1, wherein the charging/outputting circuit unit includes a circuit board and a plurality of electronic components arranged thereon, and the lighting sources are mounted on the circuit board.

5. The lighting structure of claim 1, wherein the circuit board further includes a power indicator light and a charging status indicator light mounted thereon, and the light base has a plurality of light holes formed thereon and corresponding to the power indicator light and the charging status indicator light.

6. The lighting structure of claim 1, wherein the charging/outputting circuit unit further includes a switch arranged on a lateral side thereof to turn on/off the light source and the charging socket.

7. The lighting structure of claim 1, wherein the charging/outputting circuit unit further includes a dimmer arranged on a lateral side thereof by which the light emitted from the light sources is adjusted as desired.

8. The lighting structure of claim 1, wherein the charging socket has an opening for receiving a chargeable battery, a plurality of guiding pieces respectively mounted on two opposite inner sides of the charging socket and being adjacent to the opening for electrically connecting the charging/outputting circuit unit, and a cover further pivotally mounted on the charging socket to cover the opening.

9. The lighting structure of claim 1, wherein the connector is inserted in an electric socket for domestic electric distribution via an adapter.

* * * * *